US007300317B2

(12) United States Patent
Dillon et al.

(10) Patent No.: US 7,300,317 B2
(45) Date of Patent: Nov. 27, 2007

(54) ELECTRICAL CONNECTOR HAVING A HOUSING INCLUDING AN ASYMMETRICAL SURFACE

(75) Inventors: Christopher J. Dillon, Farmington Hills, MI (US); Ping Chen, Farmington Hills, MI (US)

(73) Assignee: JST Corporation, Farmington Hills, MI (US)

( * ) Notice: Subject to any disclaimer, the term of this patent is extended or adjusted under 35 U.S.C. 154(b) by 0 days.

(21) Appl. No.: 11/296,691

(22) Filed: Dec. 8, 2005

(65) Prior Publication Data

US 2006/0148316 A1 Jul. 6, 2006

Related U.S. Application Data

(60) Provisional application No. 60/634,239, filed on Dec. 9, 2004.

(51) Int. Cl.
*H01R 13/64* (2006.01)

(52) U.S. Cl. ..... 439/678

(58) Field of Classification Search ..... 439/79, 439/82, 676, 83, 326, 660, 678
See application file for complete search history.

(56) References Cited

U.S. PATENT DOCUMENTS

| | | | | |
|---|---|---|---|---|
| 3,196,377 | A | 7/1965 | Minich | |
| 3,601,762 | A * | 8/1971 | Eshelman | 439/246 |
| 4,201,432 | A * | 5/1980 | Chalmers | 439/82 |
| 4,975,067 | A | 12/1990 | Bastijanic et al. | |
| 4,990,108 | A | 2/1991 | Sakaguchi | |
| 5,112,231 | A | 5/1992 | Harwath et al. | |
| 5,295,856 | A | 3/1994 | Endo et al. | |
| 5,431,577 | A | 7/1995 | Lincoln | |
| 5,520,550 | A | 5/1996 | Okabe | |
| 5,641,308 | A | 6/1997 | Bixler et al. | |
| 6,168,446 | B1 | 1/2001 | Tung | |
| 6,338,657 | B1 | 1/2002 | Harper et al. | |
| 6,447,340 | B1 | 9/2002 | Wu | |

(Continued)

FOREIGN PATENT DOCUMENTS

| | | |
|---|---|---|
| JP | 64-33999 | 2/1989 |
| JP | 4-133280 | 5/1992 |

*Primary Examiner*—Chandrika Prasad
(74) *Attorney, Agent, or Firm*—Nixon Peabody, LLP

(57) ABSTRACT

The invention relates to a connector device that includes a plurality of terminals of varying heights that extend upwardly from the surface of a circuit board, and a connector housing that defines a receptacle portion. The connector housing includes an asymmetrical surface adapted to receive a plurality of terminals, and each of the plurality of terminals extends through a portion of the asymmetrical surface into the receptacle portion of the connector housing. The asymmetrical surface may include a plurality of substantially parallel vertical sections separated by at least one substantially horizontal section, may be angled relative to the surface of the circuit board, or may be curved relative to the surface of the circuit board. In addition, at least a portion of the asymmetrical surface of the connector housing may protrude over at least a portion of at least one of the terminals extending between the circuit board and the asymmetrical surface. In addition, the invention provides a connector device wherein the asymmetrical surface allows for the reduction of the packaging size of the terminals and a reduction of the size of the terminals.

15 Claims, 9 Drawing Sheets

U.S. PATENT DOCUMENTS

| | | | |
|---|---|---|---|
| 6,464,540 | B1 | 10/2002 | Sato |
| 6,511,350 | B1 | 1/2003 | Ito et al. |
| 6,527,590 | B2 | 3/2003 | Oguchi |
| 6,540,560 | B1 | 4/2003 | Ito et al. |
| 6,558,199 | B2 | 5/2003 | Oguchi |
| 6,729,909 | B2 | 5/2004 | Nogami |
| 6,776,652 | B2 | 8/2004 | Nakura et al. |
| 2004/0192092 | A1 | 9/2004 | Borrego Bel et al. |
| 2004/0248474 | A1 | 12/2004 | Miyazawa et al. |
| 2004/0259426 | A1 | 12/2004 | Chang |

* cited by examiner

ELECTRICAL CONNECTOR HAVING A HOUSING INCLUDING AN ASYMMETRICAL SURFACE

RELATED APPLICATION DATA

This application claims benefit of priority of Provisional Application Ser. No. 60/634,239 filed on Dec. 9, 2004, the entire disclosure of which is incorporated herein by reference.

FIELD OF THE INVENTION

The invention relates generally to male header connector devices. More specifically, the invention relates to a male header connector device that utilizes a connector housing having an asymmetrical surface that is adapted to receive a plurality of terminals that extend from a circuit board.

BACKGROUND

Existing single-level male headers in an electrical connection are typically comprised of a housing that has a single surface for the male pin or blade terminals to be retained. FIGS. 1-5 illustrate various known configurations for male header connectors. In particular, these figures show a variety of connectors wherein a plurality of terminals 105 extend upwardly from a circuit board 110 through a surface 115 and into a receptacle portion 120 defined by a connector housing 100. For example, FIG. 1 shows a cross-sectional view of a top mounted male header connector having two rows of terminals, FIG. 2 shows a cross-sectional view of a side-mounted male header connector having two rows of terminals, FIG. 4 shows a cross-sectional view of a side-mounted male header connector having three rows of terminals, and FIG. 5 shows a cross-sectional view of a side-mounted male header have four rows of terminals.

In addition to showing connector device 100, FIG. 3 also illustrates the interrelationship between a female connector 200 and male connector device 100. When connected (i.e. when female connector 200 is positioned inside receptacle portion 120), terminals 105 of connector device 100 fit into female terminals 205 of female connector 200, thus establishing a connection.

For example, U.S. Pat. No. 5,520,550 issued to Okabe relates to an electrical connector with parallel terminals and partition plates of different lengths so that the rear end portions of the terminal storage chambers of the connector are arranged in stepped portions. The stepped portions of the connector assembly are then connected to wire leads or to a single cable. This configuration is employed to facilitate wire connections to the terminal for reducing the time required to connect the assembly.

U.S. Pat. No. 6,464,540 issued to Sato generally relates to a connector unit having a plurality of primary and secondary contact leads. The contact leads are displaced by varying distances to facilitate connection to multiple layer printed circuit boards or multiple layer receptacles. Signal path length and the delay time difference among signal transmissions (a.k.a. skew) are standardized. Different signal path lengths are employed to compensate for delay time differences among signal transmission.

These types of headers encounter various problems. For example, for connections that have multiple rows or columns of terminals, this puts limitations on the pin or blade length protruding from the retaining surface as some pins or blades may be required to be longer than needed because of varying terminal sizes inside the single connector. In addition, for right-hand, or side-mounted, connections, this also requires larger pin lengths coming out of the back of the connector.

SUMMARY OF THE INVENTION

The present invention provides a novel male header connector device. The male header connector device includes a plurality of terminals of varying heights that extend upwardly from the surface of a circuit board, and a connector housing that defines a receptacle portion. The connector housing includes an asymmetrical surface adapted to receive a plurality of terminals, and each of the plurality of terminals extends through a portion of the asymmetrical surface into the receptacle portion of the connector housing. The asymmetrical surface may also be referred to herein as a retention surface.

According to an embodiment of the invention, the asymmetrical surface of the connector housing may include a plurality of substantially parallel vertical sections separated by at least one substantially horizontal section, at least one of the horizontal sections of the asymmetrical surface of the connector housing may protrude over at least a portion of at least one of the terminals extending between the circuit board and the asymmetrical surface, and at least one horizontal section of the asymmetrical surface of the connector housing may protrude over the location on the circuit board from which at least one terminal originates.

In addition, the asymmetrical surface of the connector housing may be angled relative to the surface of the circuit board, at least a portion of the angled asymmetrical surface of the connector housing may protrude over at least a portion of at least one of the terminals extending between the circuit board and the asymmetrical surface, and a portion of the angled asymmetrical surface of the connector housing may protrude over the location on the circuit board from which at least one terminal originates.

Furthermore, the asymmetrical surface of the connector housing may be curved relative to the surface of the circuit board, that at least a portion of the curved asymmetrical surface of the connector housing may protrude over at least a portion of at least one of the terminals extending between the circuit board and the asymmetrical surface, and further that a portion of the curved asymmetrical surface of the connector housing may protrude over the location on the circuit board from which at least one terminal originates.

In addition, the invention provides a connector device wherein the asymmetrical surface allows for the reduction of the packaging size of the terminals and a reduction of the size of the terminals.

Moreover, the asymmetrical surface of the connector device of the invention may comprise a plurality of retaining surfaces. In this case, the length of at least one of the terminals inside the receptacle portion may be adjusted by moving at least one of the retaining surfaces relative to the connector housing.

Furthermore, the invention provides a connector device in which the terminals may be positioned relative to the asymmetrical surface such that the terminals are scoop-proof. As will be known to a person of ordinary skill in the art, a scoop-proof design is a design that minimizes the possibility for contact damage to the terminals.

The designs of the invention yield many advantages. For example, the length of the terminals inside the receptacle portion can be optimized to the ideal length by moving the asymmetrical surface in and out. In addition, the length of the terminals extending behind the connector housing can be optimized for all rows by moving the rows closer to the PCB in and out. Furthermore, the overall total packaging size of the male header can be optimized. Also, the terminals in the center of the connector device can be recessed back to aid in scoop-proofing the connector system.

DETAILED DESCRIPTION OF THE INVENTION

Figure 1:
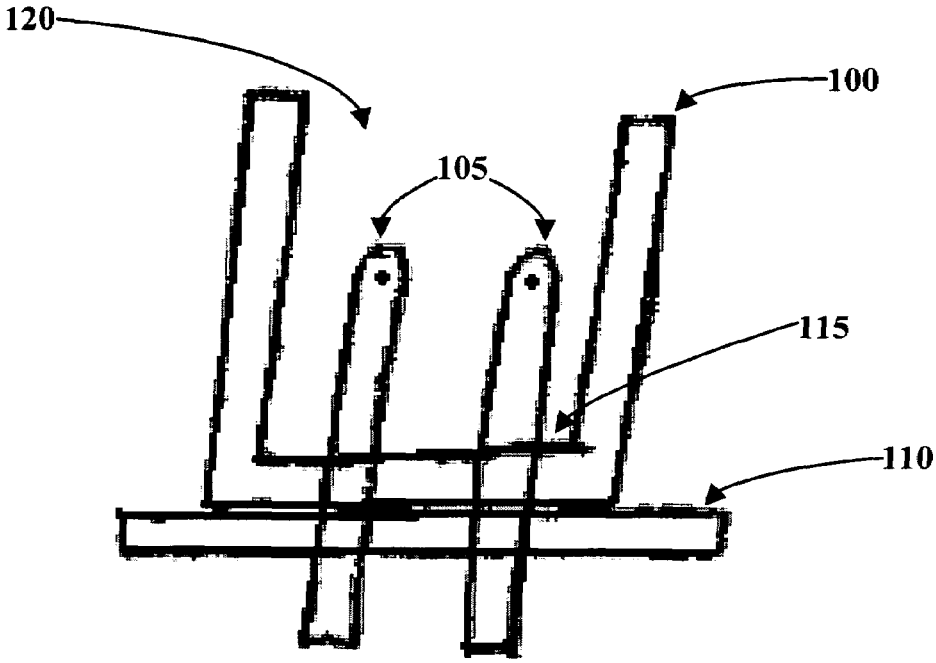
FIG. 1 (PRIOR ART)
FIG. 1 shows a cross-sectional view of a prior art top mounted male header connector having two rows of terminals.
Figure 2:
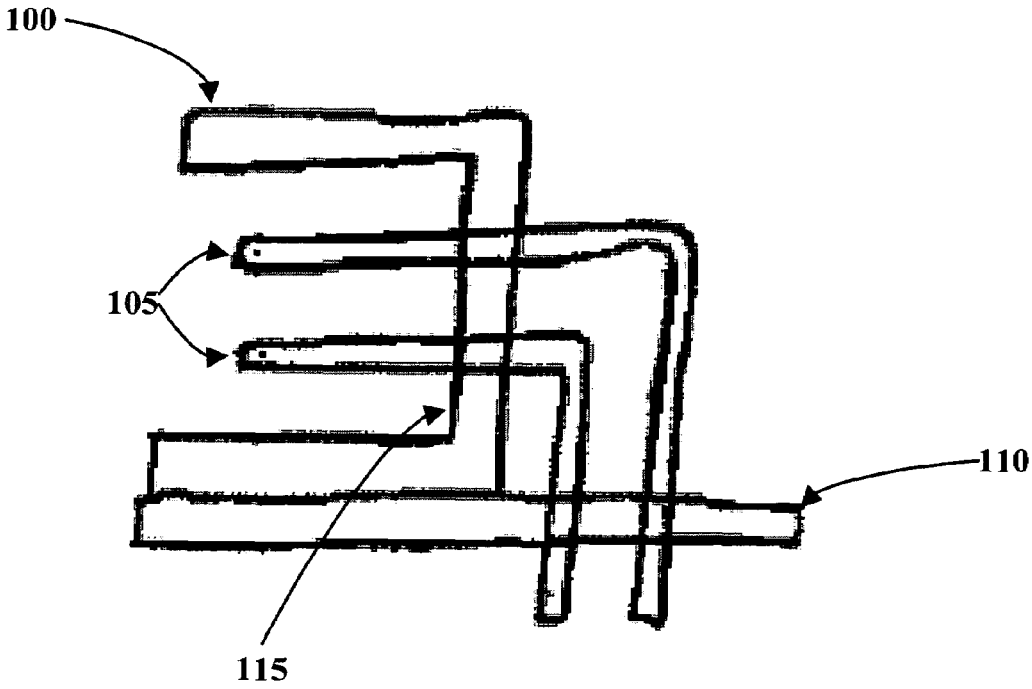
FIG. 2 (PRIOR ART)
FIG. 2 shows a cross-sectional view of a prior art side-mounted male header connector having two rows of terminals.
Figure 3:
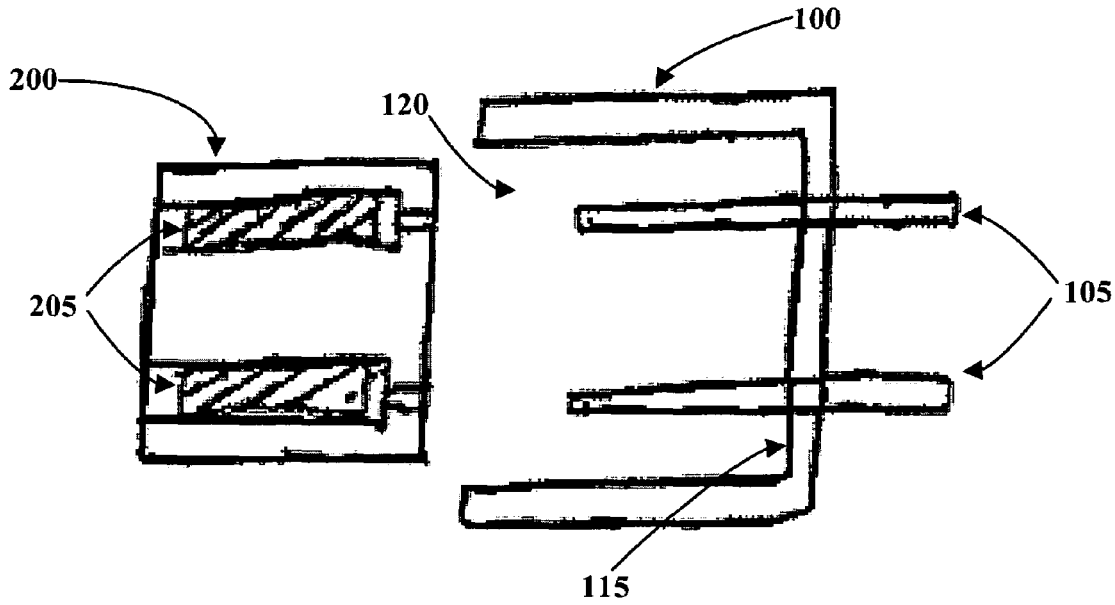
FIG. 3 (PRIOR ART)
FIG. 3 shows a cross-sectional view of the interrelationship between a female connector and a prior art male header connector prior to entering into engagement.
Figure 4:
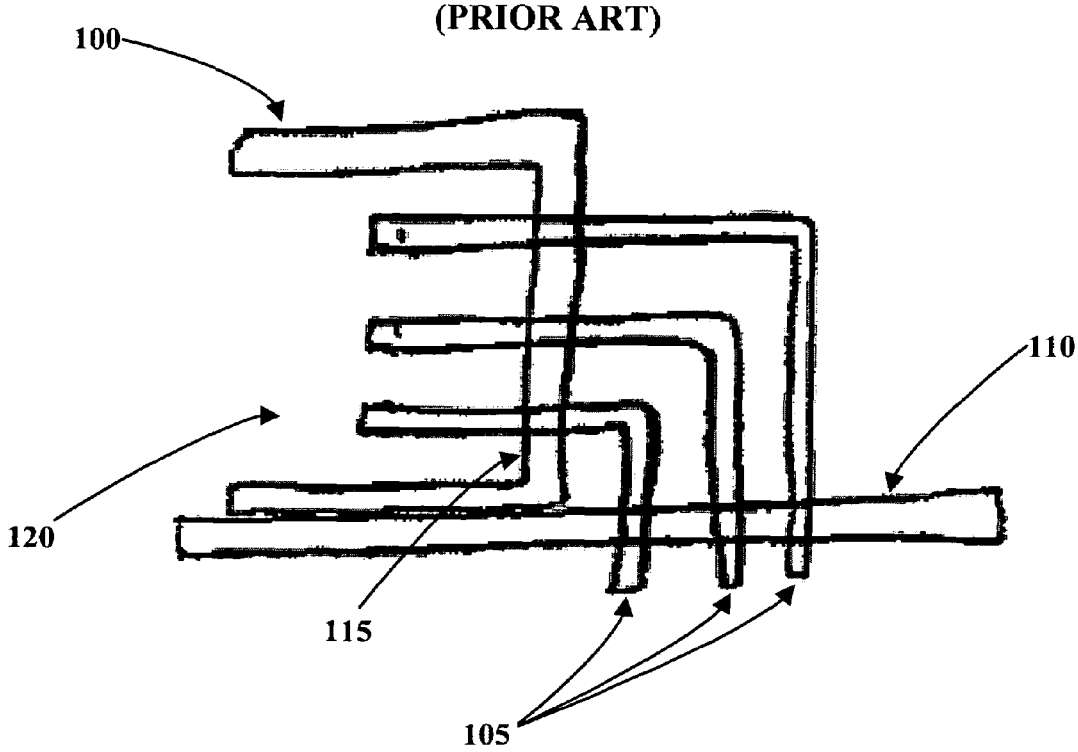
FIG. 4 (PRIOR ART)
FIG. 4 shows a cross-sectional view of a prior art side-mounted male header connector having three rows of terminals.
Figure 5:
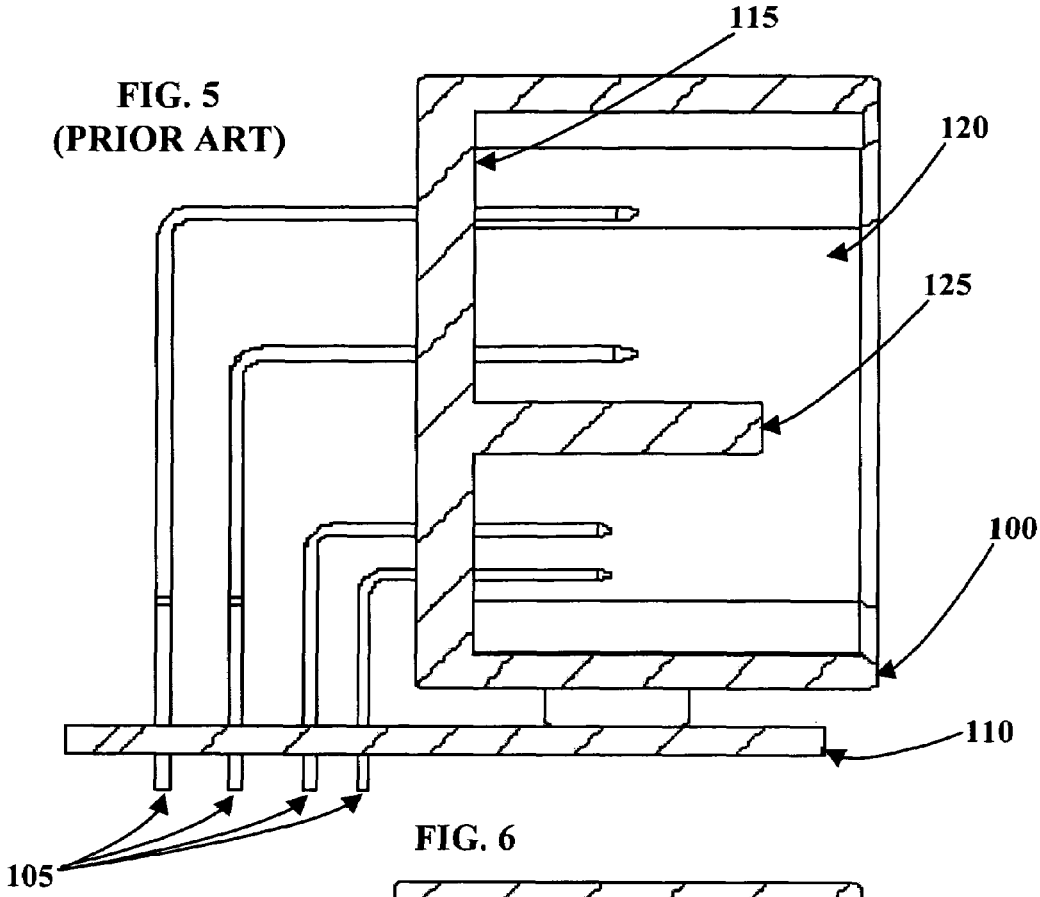
FIG. 5 (PRIOR ART)
FIG. 5 shows a cross-sectional view of a prior art side-mounted male header have four rows of terminals.
Figure 6:
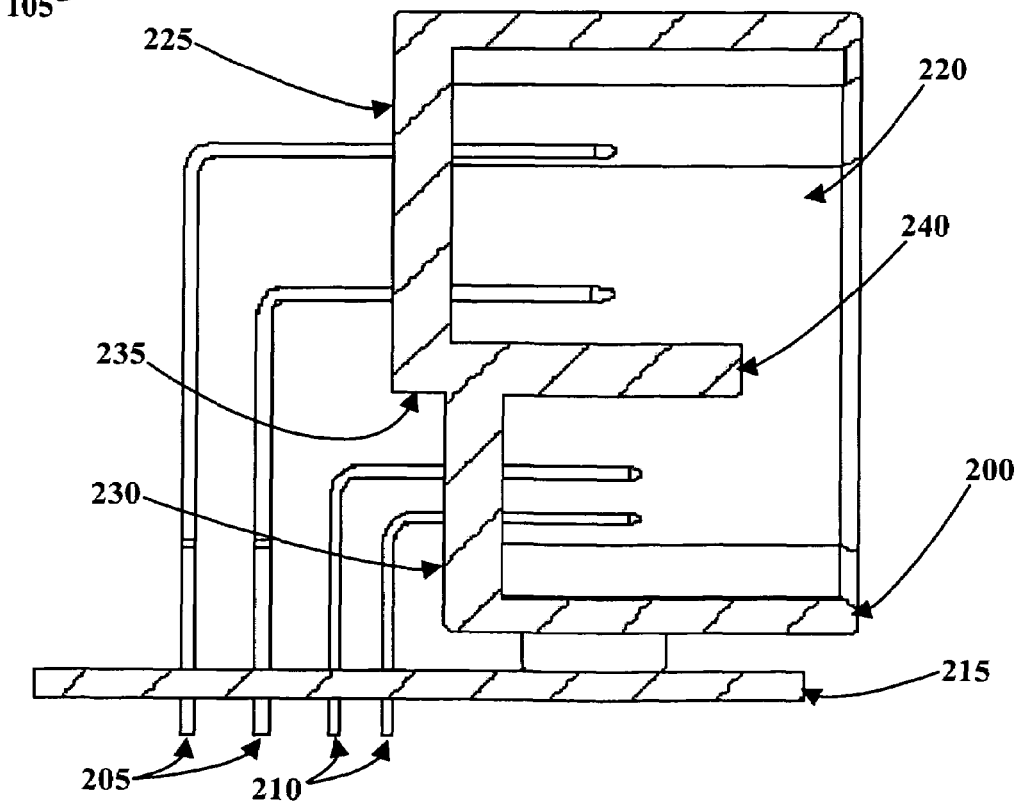
FIG. 6 shows a cross-sectional view of a connecter device of the invention having an asymmetrical surface that comprises two substantially parallel vertical sections separated by a single substantially horizontal section.

As is shown in FIG. 6, an embodiment of the invention relates to a male header connector device in which a plurality of rows of terminals 205 and 210 of varying heights extend upwards from a surface of a circuit board 215 and into a connector housing 200. Connector housing 200 defines a receptacle portion 220, and includes an asymmetrical surface comprising, for example, retention surfaces 225 and 230. Terminals 205 and 210 extend through the asymmetrical surface via retention surfaces 205 and 210, respectively, and extend into receptacle portion 220. The asymmetrical surface comprises a plurality of substantially parallel vertical sections (i.e. retention surfaces 225 and 230) separated by at least one substantially horizontal section 235. In this embodiment, horizontal section 235 extends into receptacle portion 220 as a divider 240, which separates the terminal rows 205 from terminal rows 210 inside receptacle portion 220. The horizontal and vertical sections of the asymmetrical surface may be of any suitable length and size.

By utilizing an asymmetrical surface such as the surface depicted in FIG. 6, retention surface 225 protrudes over at least a portion of terminal rows 210 and 230 extending between the circuit board and the asymmetrical surface. In this manner, the asymmetrical surface of connector housing 200 reduces the total packaging size of the connector device, which is the distance between the entrance of receptacle portion 220 and the further of the terminals, here, terminals rows 205. In particular, the total package size can be reduced by up to the length of horizontal section 235, or the offset between retention surface 225 and retention surface 230. Moreover, this arrangement allows for a reduction in the overall size of each terminal. For example, the total size of terminal rows 205 may be reduced without reducing the length of the portions of the terminals that extend into receptacle portion 220. Thus, an adequate connection can be maintained while reducing the space required by the connector device and the materials needed for the terminals themselves.

In addition, the length of the terminals inside the receptacle portion may be adjusted by moving at least a portion of the asymmetrical surface relative to connector housing 200. For example, retention surface 225 may be moved to adjust the length of terminals rows 205 extending into receptacle 220. In addition, the length of the terminals may be adjusted, for example, by cutting, to optimize the connection.

Figure 7:
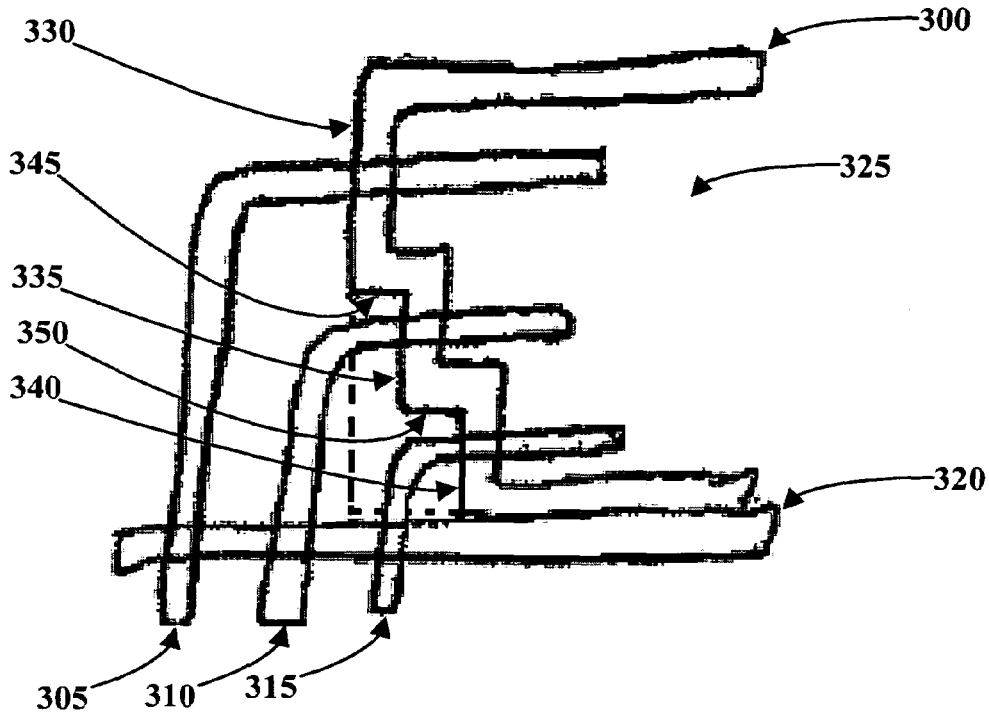
FIG. 7 shows a cross-sectional view of a male header connector device of the invention having an asymmetrical surface that comprises three substantially parallel vertical sections separated by two substantially horizontal sections.
Figure 8:
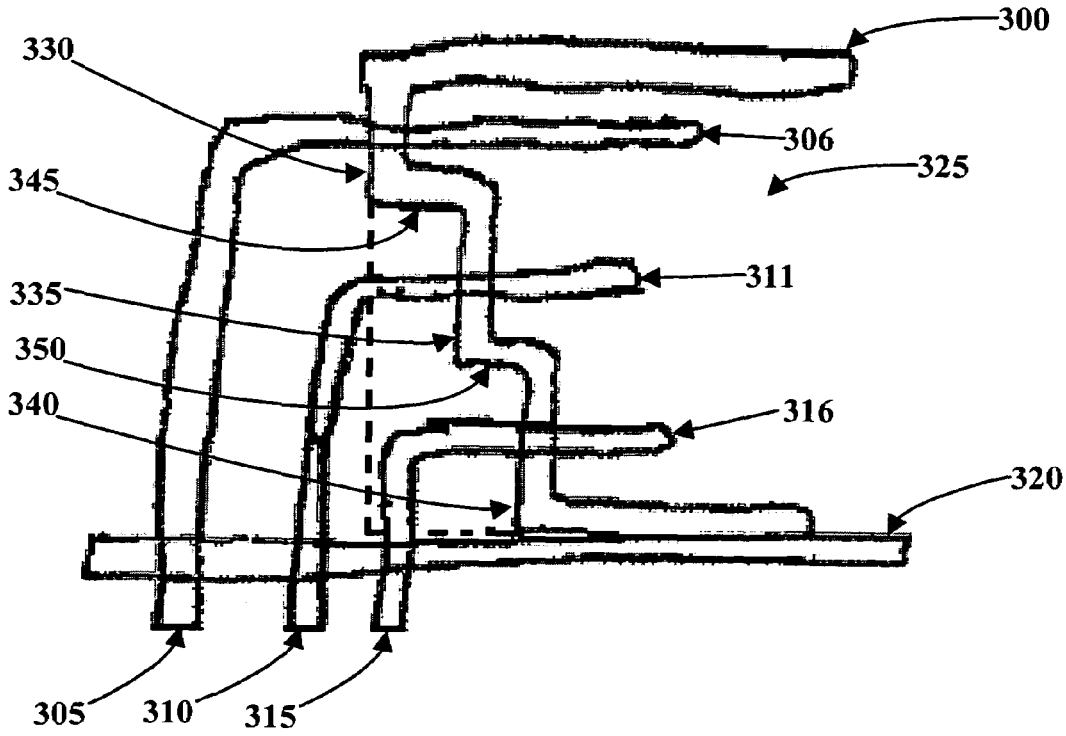
FIG. 8 shows a cross-sectional view of a male header connector device of the invention having an asymmetrical surface that comprises three substantially parallel vertical sections separated by two substantially horizontal sections.

FIGS. 7 and 8 illustrate an embodiment of the invention wherein the asymmetrical surface of a connector housing 300 is divided into three separate portions corresponding to three rows of terminals, specifically, rows of terminals 305, 310, and 315. These rows of terminals are terminals of varying heights that extend upwards from a surface of a circuit board 320 towards connector housing 300. As with the above described connector housing, connector housing 300 defines a receptacle portion 325, and the asymmetrical surface comprises three retention surfaces 305, 310, and 315. Rows of terminals 305 extend through retention surface 330, rows of terminals 310 extend through retention surface 335, and rows of terminals 315 extend through retention surface 340. Each terminal extends into receptacle portion 325. The length of the terminals within the receptacle portion may be adjusted as appropriate to optimize the connection.

Retention surfaces 330, 335, and 340 of the asymmetrical surface are substantially parallel vertical sections that are separated by two substantially horizontal sections, namely, horizontal sections 345 and 350. As an alternative to the embodiment shown in FIG. 6, these horizontal sections do not extend into receptacle portion 325.

By utilizing an asymmetrical surface such as the surface depicted in FIGS. 7 and 8, retention surfaces 330 and 335 protrudes over at least a portion of terminal rows 310 and 315, respectively. In addition, as is indicated by the dotted line in FIGS. 7 and 8, at least vertical section 330 may protrude over the location on circuit board 320 from which at least terminals 315 originates. In this manner, the asymmetrical surface of connector housing 300 reduces the total packaging size of the connector device, which is the distance between the entrance of receptacle portion 325 and the furthest of the terminals, here, terminals rows 305. In particular, the total package size can be reduced by up to the total length of the sum of horizontal sections 345 and 350, or the offset between retention surface 340 and retention surface 330. Moreover, this arrangement allows for a reduction in the overall size of each terminal. For example, the total size of terminal rows 305 and 315 may be reduced without reducing the length of the portions of the terminals that extend into receptacle portion 325. In addition, the length of each of the terminals within receptacle 325 may be adjusted to optimize the connection. In this manner, the connector may also be made to be scoop-proof by adjusting the size of particular terminals, for example, terminals 310 in FIG. 8, relative to the asymmetrical surface. By adjusting the length of particular terminals in receptacle 325, the positioning of terminal tips 306, 311, and 316 relative to one another and to connecter housing 300 can be optimized. Thus, an adequate connection can be maintained while reducing the space required by the connector device and the materials needed for the terminals themselves.

In addition, the length of the terminals inside the receptacle portion may be adjusted by moving at least a portion of the asymmetrical surface relative to connector housing 300. For example, retention surface 330 may be moved to adjust the length of terminals rows 305 extending into receptacle 325.

Figure 9:
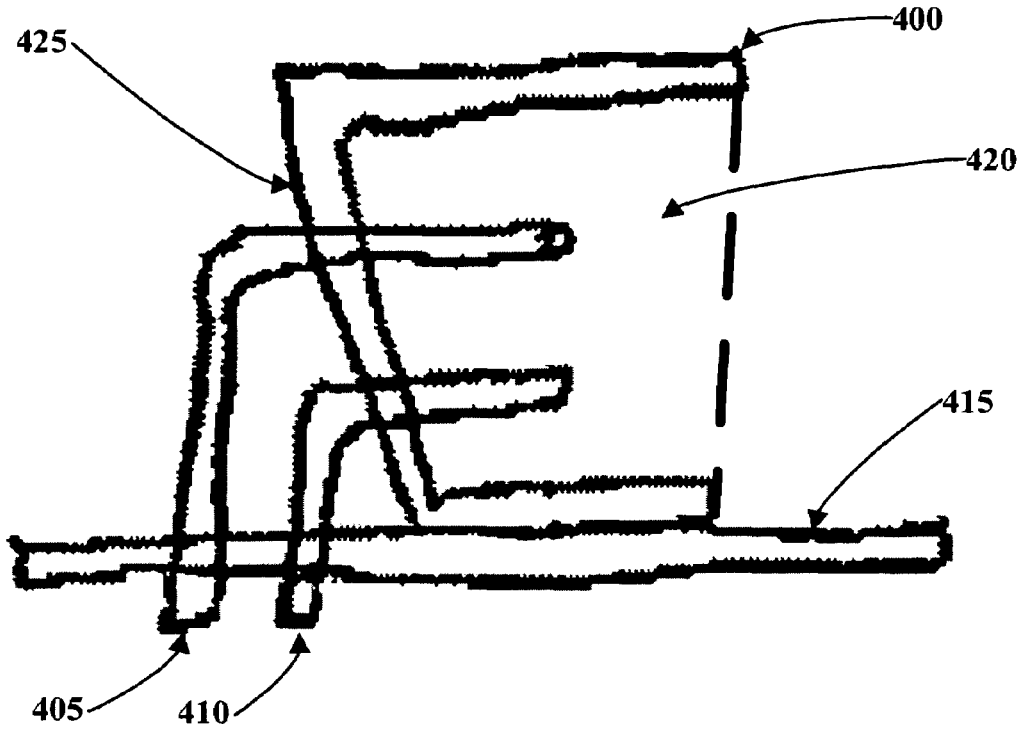
FIG. 9 shows a cross-sectional view of a male header connector device of the invention having an asymmetrical surface that is angled relative to the surface of the circuit board.
Figure 10:
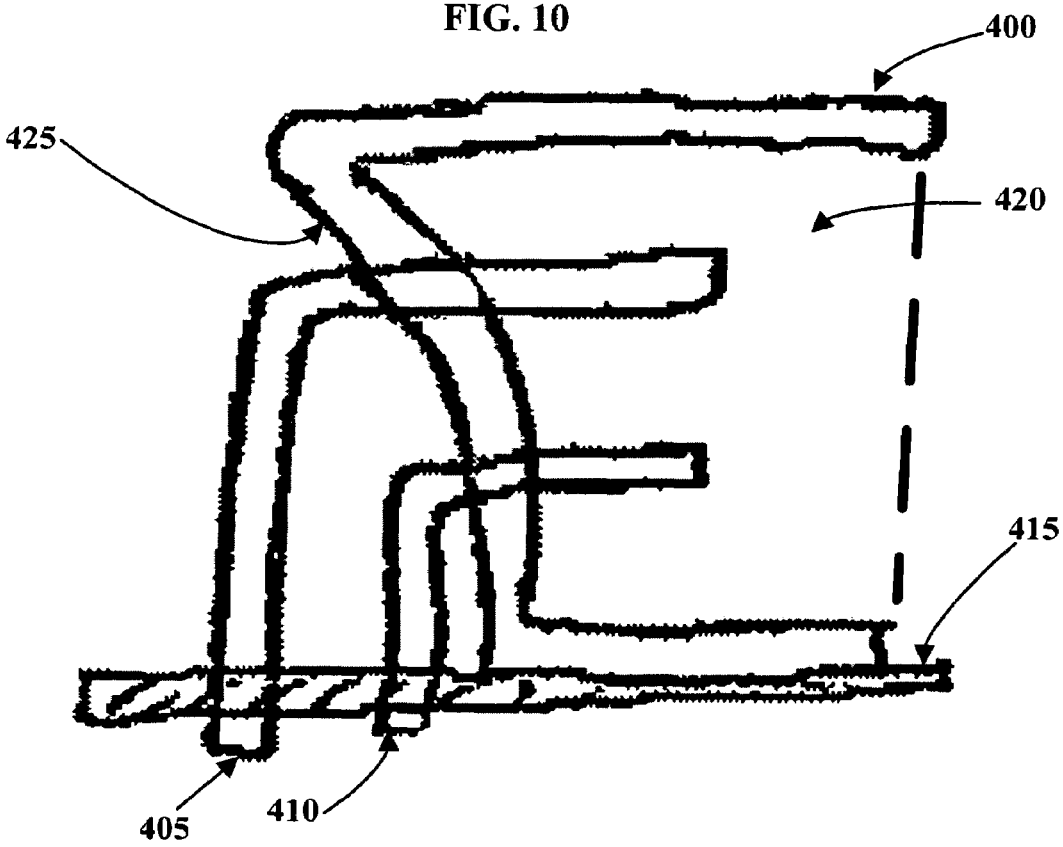
FIG. 10 shows a cross-sectional view of a male header connector device of the invention having an asymmetrical surface that is curved relative to the surface of the circuit board.

FIGS. 9 and 10 illustrate an embodiment of the invention wherein the asymmetrical surface of a connector housing 400 is either angled or curved relative a surface of the circuit board 415. Rows of terminals 405 and 410 are terminals of varying heights that extend upwards from a surface of a circuit board 415 towards connector housing 400. As with the above described connector housings, connector housing 400 defines a receptacle portion 420. Rows of terminals 405 and 410 extend through retention surface 425, and extend into receptacle 420. Also, asymmetrical surface 425 is angled in FIG. 9 and is curved in FIG. 10. The angled asymmetrical surface shown in FIG. 9 may be angled relative to circuit board 415 at any suitable angle, and the curved asymmetrical surface shown in FIG. 10 may be curved in any suitable manner and to any suitable degree. Thus, in FIGS. 9 and 10, the asymmetrical surface is not perpendicular to the sides of connector housing 400.

By utilizing an angled or curved asymmetrical surface 425, at least a portion of asymmetrical surface 425 protrudes over at least a portion of terminal rows 405 and 410. In addition, at least a portion of asymmetrical surface 425 may protrudes over the location on circuit board 415 from which at least row of terminals 410 originates. In this manner, the asymmetrical surface of connector housing 400 reduces the total packaging size of the connector device, which is the distance between the entrance of receptacle portion 420 and the furthest of the terminals, here, terminals 405. In particular, the total package size can be reduced by up to the horizontal component of the angled or curved section of asymmetrical surface 425. Moreover, this arrangement allows for a reduction in the overall size of each terminal. For example, the total size of terminal row 405 may be reduced without reducing the length of the portions of the terminals that extend into receptacle portion 420. In addition, the length of each of the terminals within receptacle 420 may be adjusted to optimize the connection. By adjusting the length of particular terminals in receptacle 420, the positioning of terminals 405 and 410 relative to one another and to connecter housing 400 can be optimized. Thus, an adequate connection can be maintained while reducing the space required by the connector device and the materials needed for the terminals themselves.

In addition, the length of the terminals inside the receptacle portion may be adjusted by moving asymmetrical surface 425 relative to connector housing 400. For example, asymmetrical housing 425 may be moved to adjust the length of terminals rows 405 and 410 extending into receptacle 420.

Figure 11:
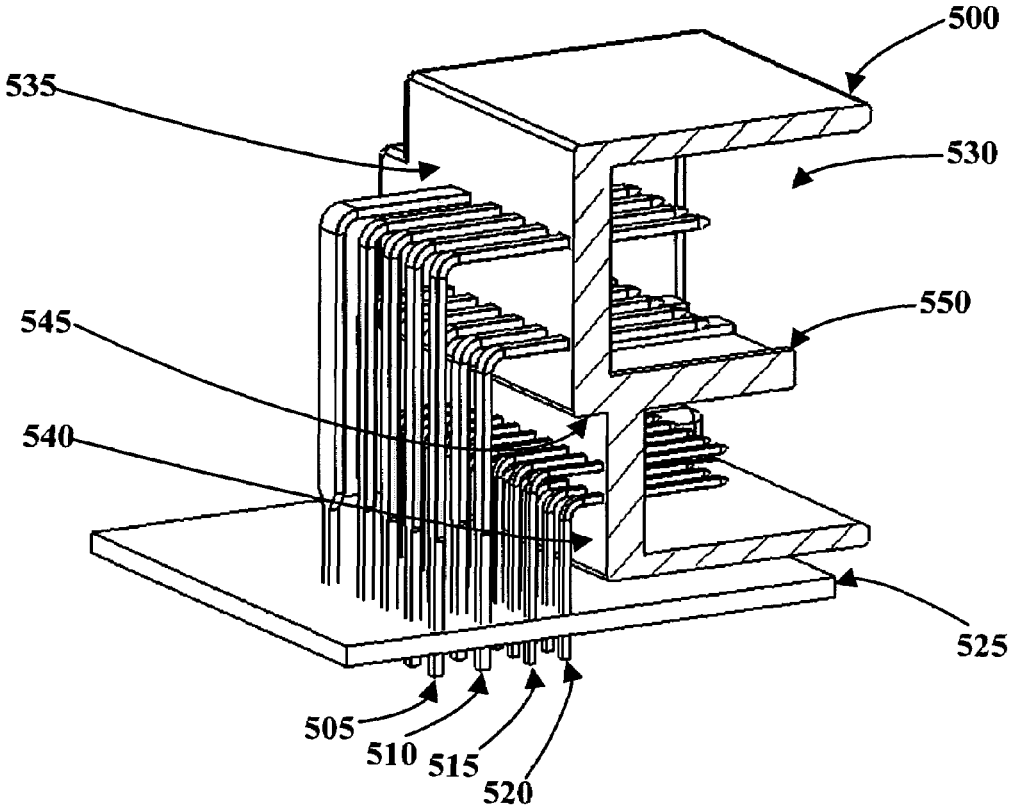
FIG. 11 shows a perspective cross-sectional view of a connector device of the invention having four rows of terminals.
Figure 12:
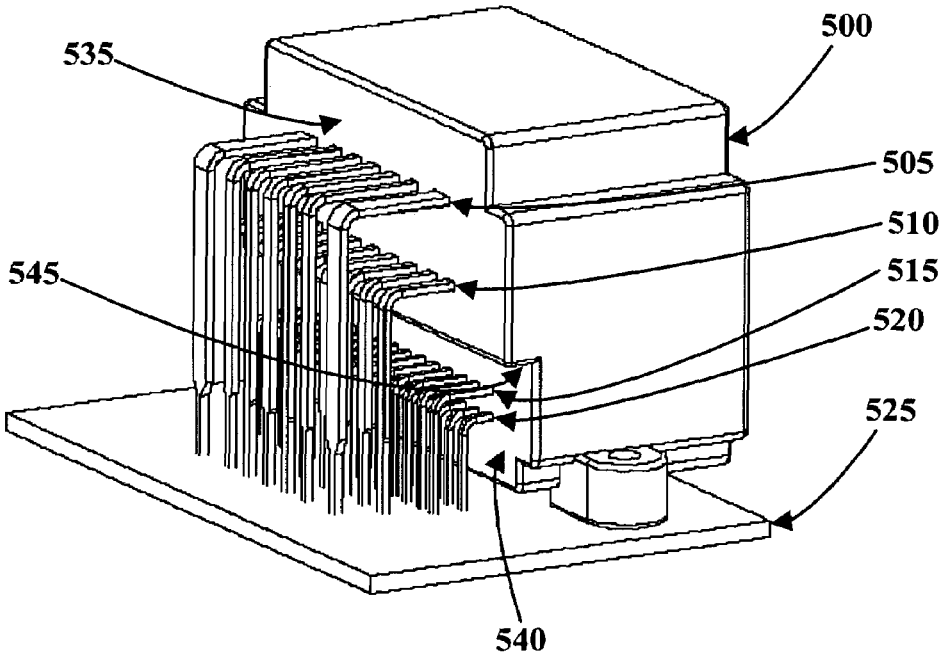
FIG. 12 shows a perspective external view of a connector device of the invention having four rows of terminals.
Figure 13:
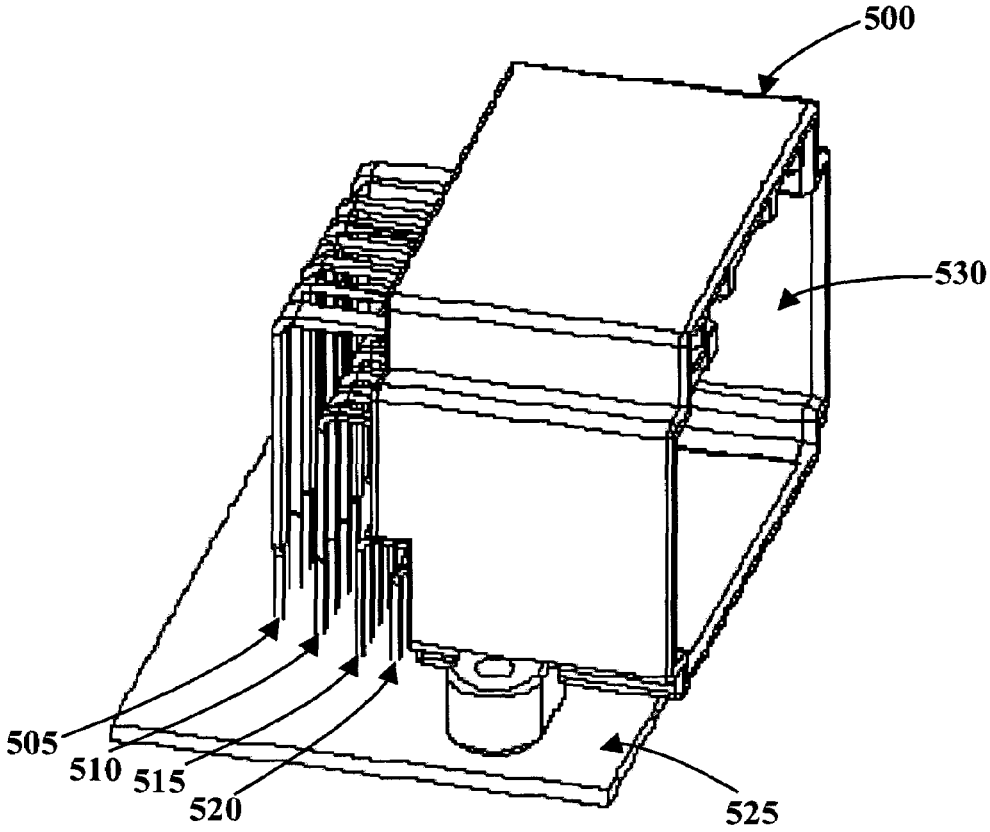
FIG. 13 shows a perspective external view of a connector device of the invention having four rows of terminals.
Figure 14:
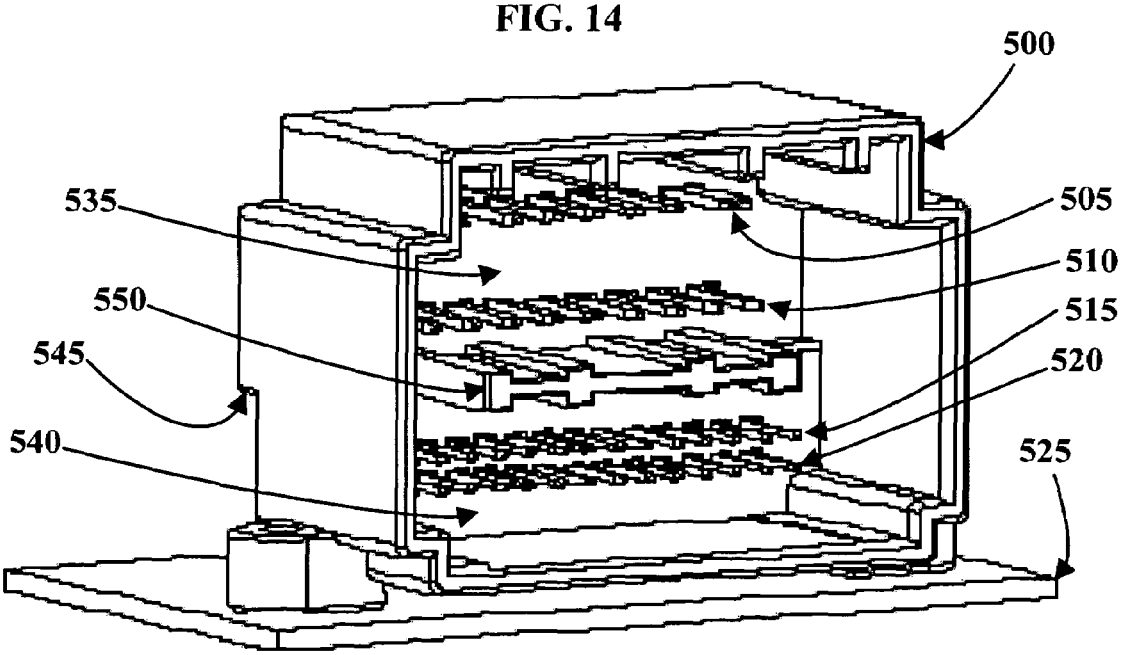
FIG. 14 shows a perspective internal view of a connector device of the invention having four rows of terminals.
Figure 15:
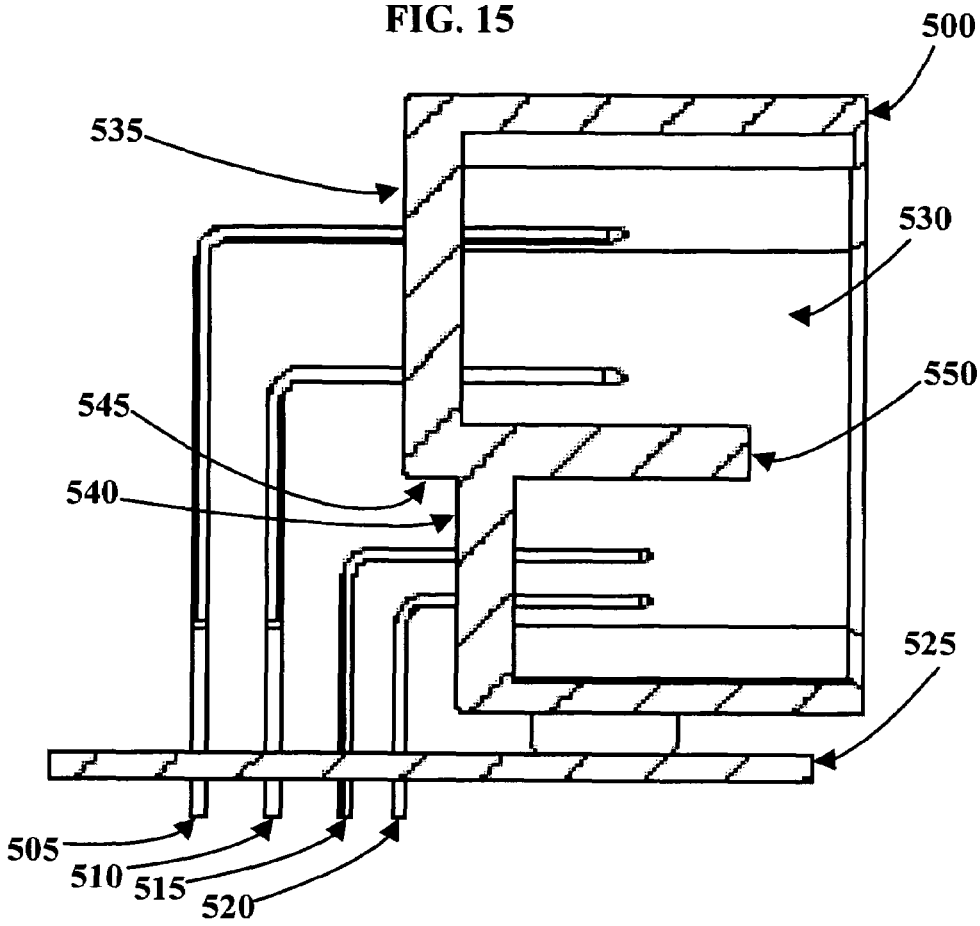
FIG. 15 shows a cross-sectional view of a connector device of the invention having four rows of terminals.
Figure 16:
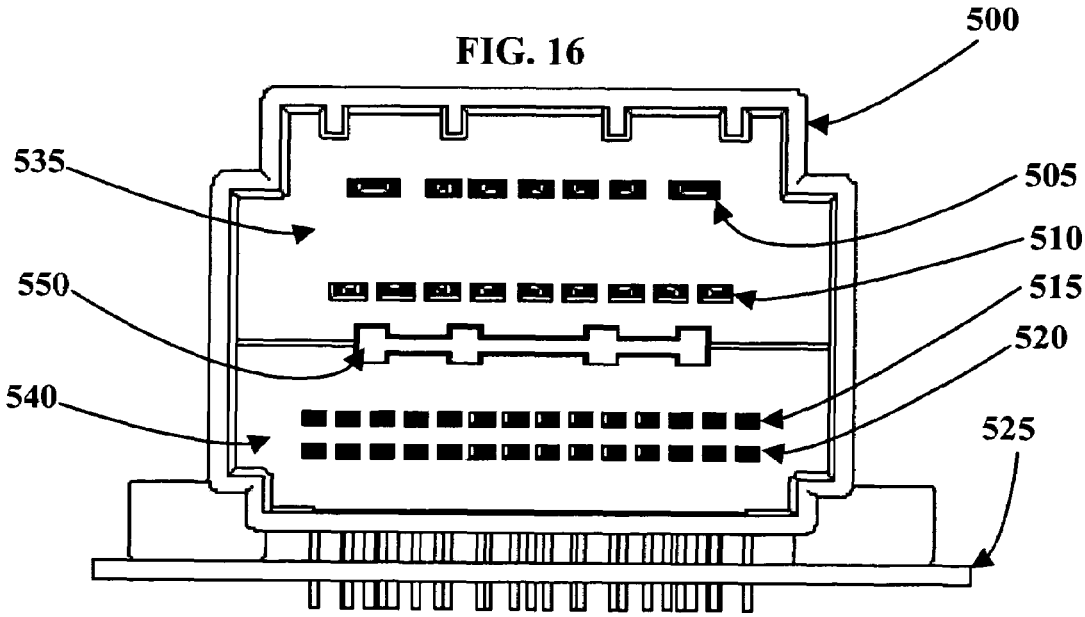
FIG. 16 shows an internal view of a connector device of the invention having four rows of terminals.
Figure 17:
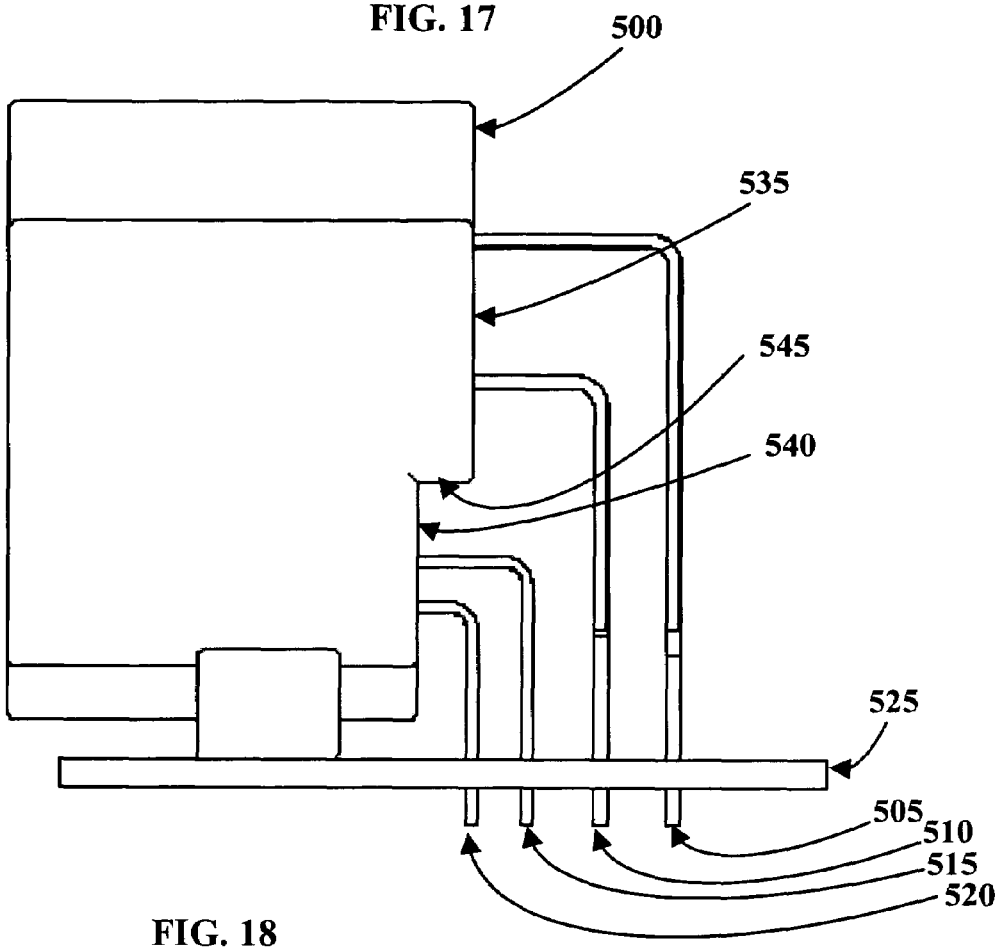
FIG. 17 shows an external view of a connector device of the invention having four rows of terminals.

FIGS. 11-17 illustrate a preferred embodiment of the invention in which the connector device of the invention is used in combination with four rows of terminals. In particular, FIG. 11 shows a perspective cross-sectional view the connector device, FIGS. 12 and 13 show a perspective external view of the connector device, FIG. 14 shows a perspective internal view of the connector device, FIG. 15 shows a cross-sectional view of the connector device, FIG. 16 shows an internal view of the connector device, and FIG. 17 shows an external view of the connector device.

The connector device comprises a connector housing 500 that defines a receptacle portion 530. Connector housing further comprises an asymmetrical surface comprised of substantially vertical sections 535 and 540, also referred to as retention surfaces 535 and 540, and a substantially horizontal section 545. Rows of terminals 505, 510, 515, and 520, which are also referred to as terminals 505, 510, 515, and 520, respectively, extend upwards from a surface of circuit board 525 and enter into receptacle portion 530 through retention surfaces 535 and 540. Each row of terminals may comprise any number of individual terminals.

As shown in FIGS. 11-17, the asymmetrical surface is comprised of two vertical sections 535 and 540, which are substantially parallel, and are offset from one another by horizontal section 545. In addition, horizontal section 545 extends into receptacle portion 530 as divider 550, and separates the rows of terminals above the divider from those located below the divider.

By utilizing an asymmetrical surface such as the surface depicted in FIGS. 11-17, retention surface 535 protrudes over at least a portion of terminal rows 515 and 520. The amount of protrusion in this manner is controlled by the width of horizontal section 545. Thus, the asymmetrical surface of connector housing 500 reduces the total packaging size of the connector device, which is the distance between the entrance of receptacle portion 530 and the furthest of the terminals, here, terminal row 505. In particular, the total package size can be reduced by up to the total length of horizontal section 545, or the offset between retention surfaces 535 and 540. Moreover, this arrangement allows for a reduction in the overall size of each terminal. For example, the total size of terminal rows 505 and 510 may be reduced without reducing the length of the portions of the terminals that extend into receptacle portion 530. In addition, the length of each of the terminals within receptacle 530 may be adjusted to optimize the connection. In this manner, the connector may also be made to be scoop-proof by adjusting the size of particular terminals relative to the asymmetrical surface. By adjusting the length of particular terminals in receptacle portion 530, the positioning of the tips of the terminals relative to one another and to connecter housing 500 can be optimized. Thus, an adequate connection can be maintained while reducing the space required by the connector device and the materials needed for the terminals themselves.

In addition, the length of the terminals inside the receptacle portion may be adjusted by moving at least a portion of the asymmetrical surface relative to connector housing 500. For example, retention surface 535 may be moved to adjust the length of terminal rows 505 and 510 extending into receptacle 530.

Figure 18:
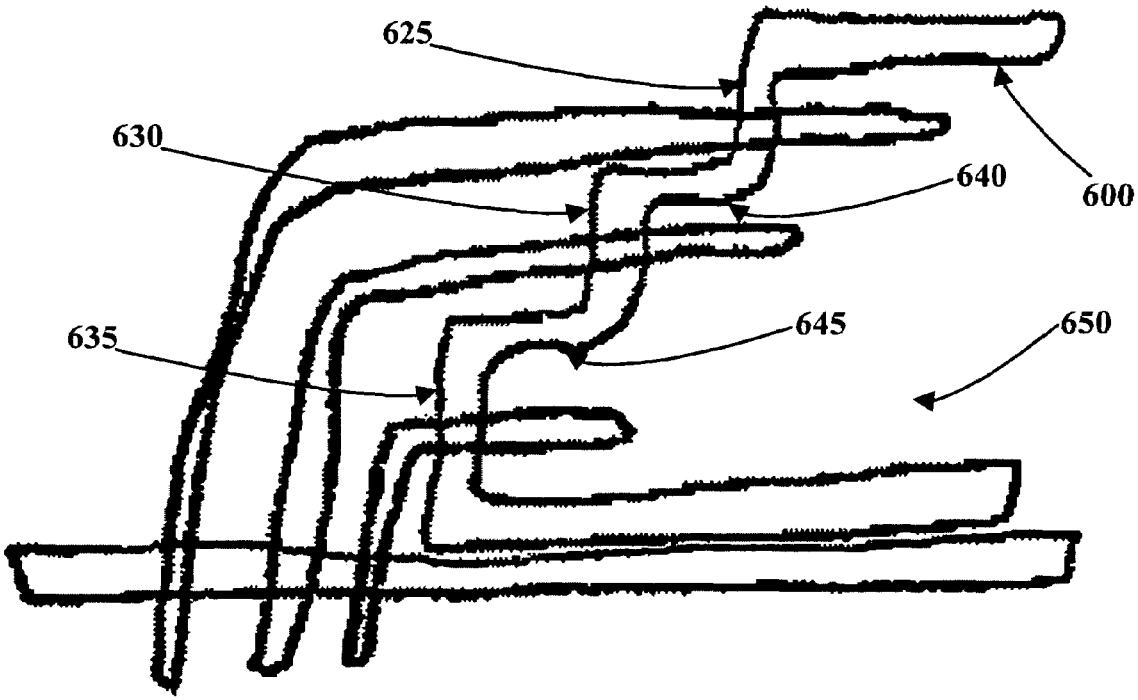
FIG. 18 shows an alternate design for a male header connector device of the invention having an asymmetrical surface that comprises three substantially parallel vertical sections separated by two substantially horizontal sections.

FIG. 18 shows an embodiment of the invention in which the asymmetrical surface of a connector housing 600 comprises three vertical sections, namely, retention surfaces 625, 630, and 635, which are separated by horizontal surfaces 640 and 645. However, contrary to the above described embodiments, the offset between retention surfaces 625, 630, and 635 protrudes towards a receptacle portion 650 defined by connector housing 600, rather than away from receptacle portion 600. This arrangement allows for a robust, optimized connection, and exemplifies that the asymmetrical surface may be modified in any manner to achieve optimization of the connector device.

While the invention has been described with particular reference to the preferred embodiments, it will be under stood by those skilled in the art that various changes may be made and equivalents substituted for elements of the preferred embodiment without departing from the invention. In addition, many modifications may be made to adapt a particular situation and material to a teaching of the present invention without departing from the essential teachings of the present invention.

As is evident from the foregoing discussion, certain aspects of the invention are not limited to the particular details of the examples illustrated, and it is therefore comtemplated that other modifications and applications will occur to those skilled in the art. It is accordingly intended that the claims shall cover all modifications and applications as do not depart from the spirit and scope of the invention.

What is claimed is:

1. A male header connector device comprising:

a plurality of terminals of varying heights extending upwards from a surface of a circuit board, such that at least one of the terminals extends upwards in a substantially perpendicular direction relative to the surface of the circuit board; and a connector housing defining a receptacle portion, the connector housing including an asymmetrical surface adapted to receive the plurality of terminals, wherein each of the plurality of terminals extends through a portion of the asymmetrical surface into the receptacle portion of the connector housing, and at least one of the terminals is curved toward the asymmetrical surface before contact with the asymmetrical surface, such that the at least one of the terminals is oriented substantially parallel to the surface of the circuit board at the point at which the at least one terminal first comes into contact with the asymmetrical surface; and wherein at least a portion of the asymmetrical surface of the connector housing protrudes over at least a portion of at least one of the terminals extending between the circuit board and the asymmetrical surface.

2. The connector device of claim 1, wherein the asymmetrical surface comprises a plurality of substantially parallel vertical sections separated by at least one substantially horizontal section.

3. The connector device of claim 2, wherein at least one of the horizontal sections of the asymmetrical surface of the connector housing protrudes over at least a portion of at least one of the terminals extending between the circuit board and the asymmetrical surface.

4. The connector device of claim 3, wherein the at least one horizontal section of the asymmetrical surface of the connector housing protrudes over the location on the circuit board from which the at least one terminal originates.

5. The connector device of claim 1, wherein the asymmetrical surface is angled relative to the surface of the circuit board.

6. The connector device of claim 5, wherein at least a portion of the angled asymmetrical surface of the connector housing protrudes over at least a portion of at least one of the terminals extending between the circuit board and the asymmetrical surface.

7. The connector device of claim 6, wherein the portion of the angled asymmetrical surface of the connector housing protrudes over the location on the circuit board from which the at least one terminal originates.

8. The connector device of claim 1, wherein the asymmetrical surface is curved relative to the surface of the circuit board.

9. The connector device of claim 8, wherein at least a portion of the curved asymmetrical surface of the connector housing protrudes over at least a portion of at least one of the terminals extending between the circuit board and the asymmetrical surface.

10. The connector device of claim 9, wherein the portion of the curved asymmetrical surface of the connector housing protrudes over the location on the circuit board from which the at least one terminal originates.

11. The connector device of claim 1, wherein the asymmetrical surface results in terminals having a smaller size.

12. The connector device of claim 11, wherein the reduction of the size of the terminals thereby enabling the terminals to be packaged in smaller packages.

13. The connector device of claim 1, wherein the asymmetrical surface comprises a plurality of retaining surfaces.

14. The connector device of claim 10, wherein the length of at least one of the terminals inside the receptacle portion may be adjusted by moving at least one of the retaining surfaces relative to the connector housing.

15. The connector device of claim 1, wherein the terminals are positioned relative to the asymmetrical surface such that the terminals are scoop-proof.

* * * * *